US012264547B2

(12) United States Patent
Alissa et al.

(10) Patent No.: US 12,264,547 B2
(45) Date of Patent: Apr. 1, 2025

(54) WELLHEAD CORROSION MITIGATION

(71) Applicant: SAUDI ARABIAN OIL COMPANY, Dhahran (SA)

(72) Inventors: Faisal Mohammed Alissa, Dammam (SA); Norah Waled Aljuryyed, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/065,754

(22) Filed: Dec. 14, 2022

(65) Prior Publication Data

US 2024/0200419 A1 Jun. 20, 2024

(51) Int. Cl.
*E21B 33/03* (2006.01)

(52) U.S. Cl.
CPC ..... *E21B 33/03* (2013.01)

(58) Field of Classification Search
CPC ..... E21B 33/03
See application file for complete search history.

(56) References Cited

U.S. PATENT DOCUMENTS 7,160,379 B1 * 1/2007 Shoshany ..... C08L 91/06 106/272
9,862,881 B2 1/2018 Drake et al.
2006/0257643 A1 * 11/2006 Birger ..... C09C 3/08 428/323
2013/0081955 A1 * 4/2013 Al-Mubasher ..... E21B 33/0375 204/196.36
2016/0069162 A1 * 3/2016 Lynch ..... E21B 33/03 405/52
2016/0137904 A1 5/2016 Drake et al.
2019/0062564 A1 2/2019 Eiberweiser et al.
2019/0194600 A1 * 6/2019 Alibek ..... A01N 63/22
2019/0203574 A1 * 7/2019 Yi ..... E21B 43/11

FOREIGN PATENT DOCUMENTS

WO 2018091986 A1 5/2018

OTHER PUBLICATIONS

Ahmad, Zaki et al.; 2015; Hydrophobicity—A Green Technique for Enhancing Corrosion Resistance of Alloys, New Trends in Alloy Development, Characterization and Application, IntechOpen.

Lesbayev, B.T., et al; 2014; Hydrophobic Sand on the Basis of Superhydrophobic Soot Synthesized in the Flame. Journal of Materials Science and Chemical Engineering, 2, 63-65.

* cited by examiner

*Primary Examiner* — Brad Harcourt
(74) *Attorney, Agent, or Firm* — Vorys, Sater, Seymour and Pease, LLP

(57) ABSTRACT

The present disclosure relates to a system including: a wellhead including: a landing base; a wellhead pipe, wherein the wellhead pipe extends from the landing base; and a surface casing, wherein the surface casing at least partially surrounds the wellhead pipe; a hydrophobic sand pack including a hydrophobic sand, the hydrophobic sand pack at least partially surrounding: the landing base, the wellhead pipe, the surface casing, or any combination thereof.

16 Claims, 5 Drawing Sheets

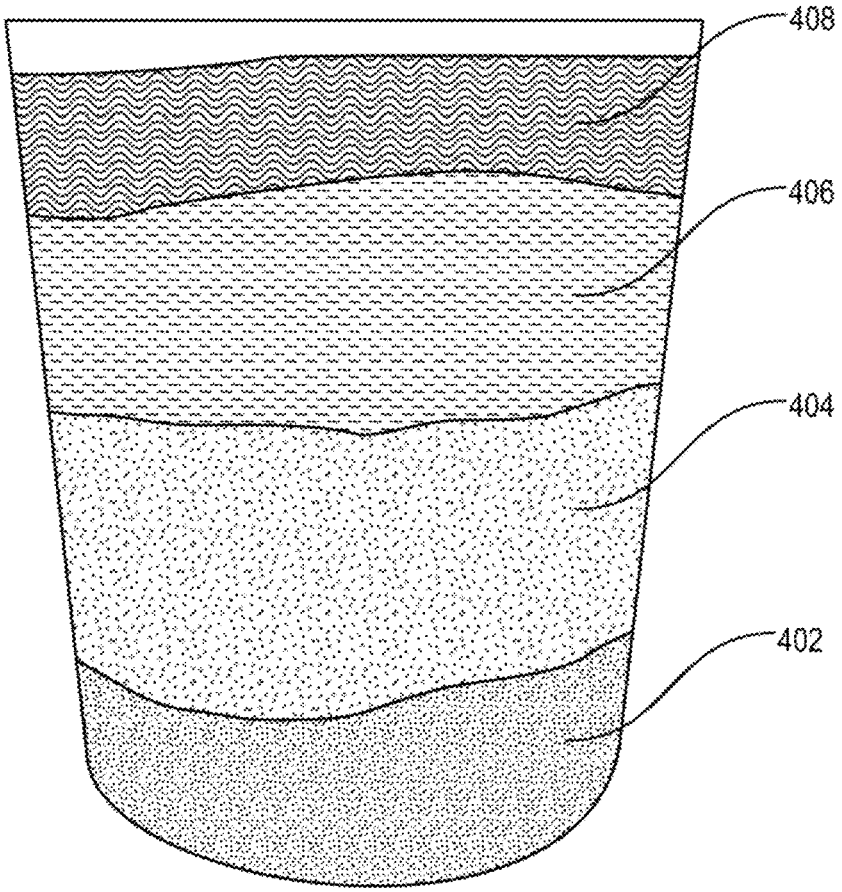
FIG. 4
*[AMENDED]*

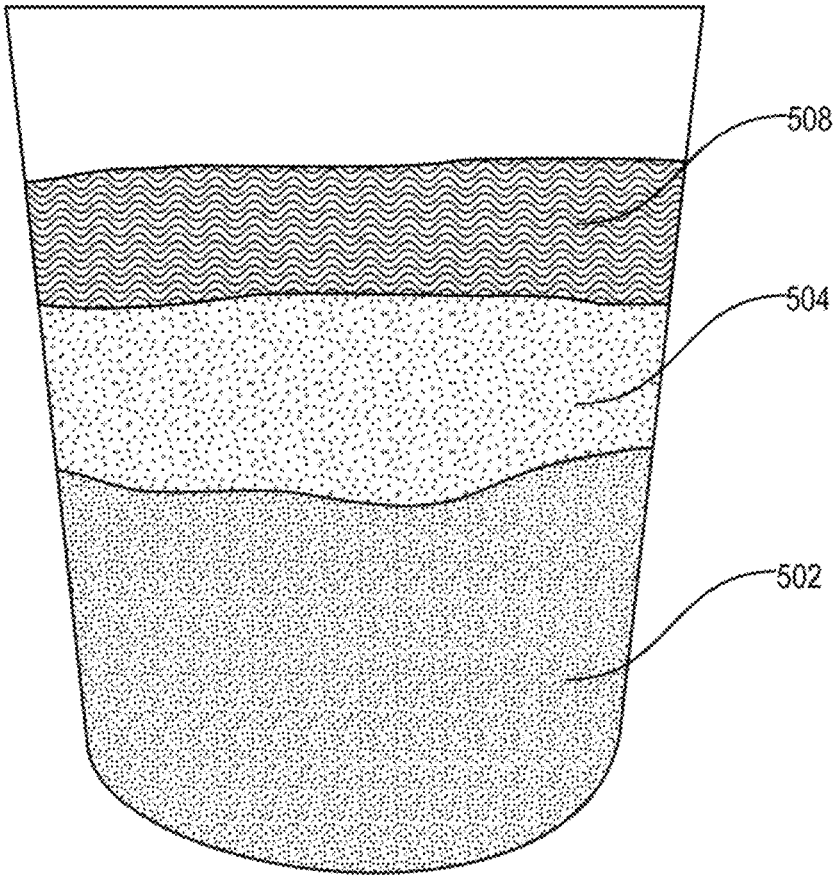
FIG. 5
*[AMENDED]*

WELLHEAD CORROSION MITIGATION

FIELD OF THE DISCLOSURE

The present disclosure relates generally to mitigation of wellhead corrosion.

BACKGROUND OF THE DISCLOSURE

Wellheads are typically used for producing hydrocarbons, water, and other fluids, and for injection of fluids into a subterranean space. Operation of a wellhead often involves risk of corrosion in many environments, particularly at marine environments, in rainy environments, or where surrounding earth retains water. Corrosion may reduce operational capability and may require costly remediation or replacement of components of the wellhead. One location where corrosion is particularly costly to remediate is the well cellar of a wellhead. The well cellar of a wellhead may be, at least partially underground and, as a result, remediation of corrosion in the well cellar may comprise deep excavation and replacement of components. This may be costly not only due to the expense of replacement but also costly as a result of lost operational capability of the wellhead.

Current methods of mitigating corrosion of the well cellar may involve coatings that may require periodic reapplication. Said reapplication may be costly because of the required excavation of portions of the wellhead that are underground like the well cellar.

SUMMARY OF THE DISCLOSURE

Various details of the present disclosure are hereinafter summarized to provide a basic understanding. This summary is not an exhaustive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

A nonlimiting system of the present disclosure comprises: a wellhead comprising: a landing base; a wellhead pipe, wherein the wellhead pipe extends from the landing base; and a surface casing, wherein the surface casing at least partially surrounds the wellhead pipe; a hydrophobic sand pack comprising a hydrophobic sand, the hydrophobic sand pack at least partially surrounding: the landing base, the wellhead pipe, the surface casing, or any combination thereof.

A nonlimiting method of the present disclosure comprises: providing a wellhead comprising: a landing base; a wellhead pipe, wherein the wellhead pipe extends from the landing base; and a surface casing, wherein the surface casing at least partially surrounds the wellhead pipe; at least partially surrounding the landing base, the wellhead pipe, the surface casing, or any combination thereof with a hydrophobic sand pack comprising a hydrophobic sand.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

BRIEF DESCRIPTION OF THE DRAWINGS

FIG. 4 illustrates an experimental setup for testing hydrophobic sand.

FIG. 5 illustrates an alternate experimental setup for testing hydrophobic sand.

DETAILED DESCRIPTION

Figure 1:
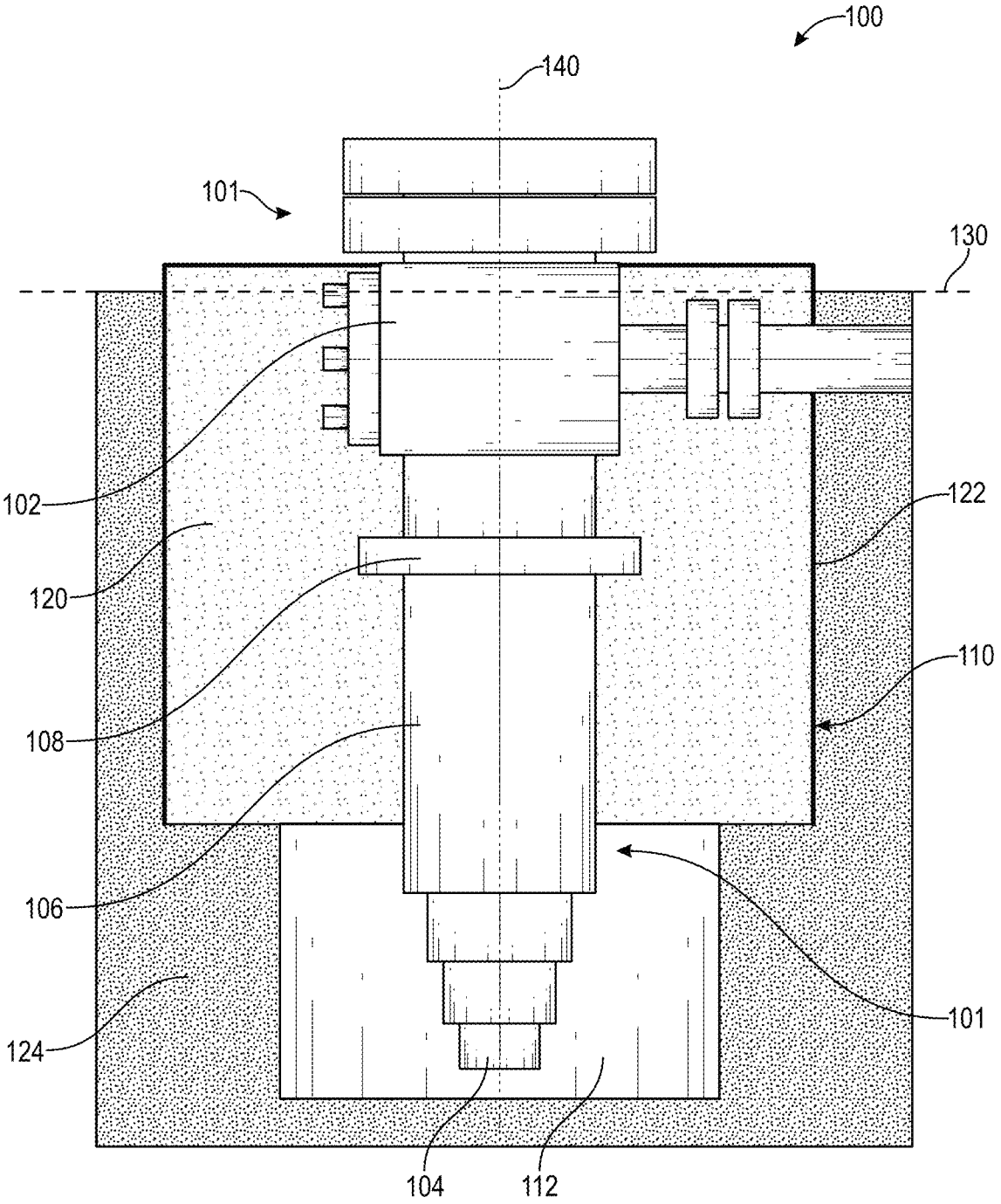
FIG. 1 illustrates a nonlimiting example system comprising a wellhead and a hydrophobic sand pack.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to mitigating wellhead corrosion.

The present disclosure provides systems and methods for mitigating wellhead corrosion, including well cellar corrosion, through the use of a hydrophobic sand pack comprising hydrophobic sand. Generally, the hydrophobic sand pack described herein surrounds at least a portion of the wellhead within and adjacent to the well cellar, which may include, but is not limited to, the landing base, the wellhead pipe, the surface casing, the cemented base, or any combination thereof. The hydrophobic sand may mitigate water ingress to the portions of the wellhead that the sand pack surrounds.

"Hydrophobic sand" refers to sand that has been functionalized (to any degree) with a compound that increases the hydrophobicity of the sand. Said compound that increases the hydrophobicity of the sand when the sand is functionalized therewith is referred to herein as a "hydrophobic compound."

"Corrosion" as used herein refers to deterioration of a material as a result of contact with a degradative species in its surroundings. In the case of the present disclosure, corrosion may include, but is not limited to, water wetting, scale formation, solid accumulation, or any other corrosion method or type known in the art, as well as any combination thereof.

As used herein when referring to a hydrophobic sand pack surrounding a component of a wellhead, the terms "surrounds," "surrounded by," and the like refer to the hydrophobic sand being located radially outward from the centerline of the wellhead at a depth or height of at least a portion of the component of the wellhead. The hydrophobic sand may form an arc of any number of circumferential degrees (e.g., a 5° arc to a 360° arc) relative to the centerline of the wellhead at the component of the wellhead. The terms "surrounds," "surrounded by," and the like are similarly applied to the containment structure when referring to a containment structure surrounding a hydrophobic sand pack.

The hydrophobic sand pack of the present disclosure may mitigate corrosion in a cost effective manner by utilizing readily available sand with a hydrophobic modification to mitigate water ingress. Said hydrophobic modification may be performed in large batches in, for example, mixers, which may allow for producing the material on-site.

The hydrophobic sand packs of the present disclosure may be installed at or above ground level to mitigate water absorbing into the ground area from above. Further, the hydrophobic sand packs of the present disclosure may also be installed at least partially below ground to mitigate water ingress from around the wellhead. The hydrophobic sand packs of the present disclosure may extend, for example, a meter or so from the wellhead, which may provide a more durable barrier to water ingress than traditional anti-corrosion paints and coatings that are simply applied to components of the wellhead.

Maintaining corrosion mitigation over time can be important. For traditional paints and coatings, this may mean that costly excavation of below-ground portions of the wellhead need to occur to re-apply said anti-corrosion paints and coatings. However, advantageously, the hydrophobic sand packs of the present disclosure may be sufficiently sized (e.g., depth, height, distance extending from the wellhead, and the like) to provide robust water ingress mitigation such that replacement is needed less often, if even needed, thereby reducing or eliminating the excavation costs. For example, the hydrophobic sand packs of the present disclosure may mitigate ingress of greater than 99 vol % of liquid water from a surface of the hydrophobic sand pack to an interior of the hydrophobic sand pack over a period of 30 days.

A nonlimiting example system according to the present disclosure is shown in FIG. 1. The system 100 may comprise a wellhead 101 that may comprise a landing base 102. The wellhead 101 may further comprise a wellhead pipe 104 extending from the landing base 102. The wellhead 101 may further comprise a surface casing 106 surrounding the wellhead pipe 104. The wellhead 101 may also have a donut plate 108 located on the surface casing 106. The wellhead 101 and constituent components may be located, at least partially, in a well cellar 110. The well cellar 110 may further comprise a cemented base 112, which may surround a portion of the surface casing 106. The centerline of the wellhead 101 is shown by dashed line 140.

The system 100 may further comprise a hydrophobic sand pack 120 that may, at least partially, surround portions of the wellhead 101 including the landing base 102, the wellhead pipe 104, the surface casing 106, and the cemented base 112. System 100 may comprise a hydrophobic sand pack 120 that is largely below ground level (ground level is indicated by reference character 130). However, as described herein, the hydrophobic sand pack may exist at ground level, below ground level, above ground level, or any combination thereof. The hydrophobic sand pack 120 may at least partially be located within the well cellar 110, may at least partially surround the well cellar 110, or any combination thereof. The system 100 may optionally further comprise providing a containment structure 122 for the hydrophobic sand pack 120. Additionally, in system 100, the hydrophobic sand pack 120 is shown at least partially resting on and at least partially surrounded by ground 124.

Figure 2:
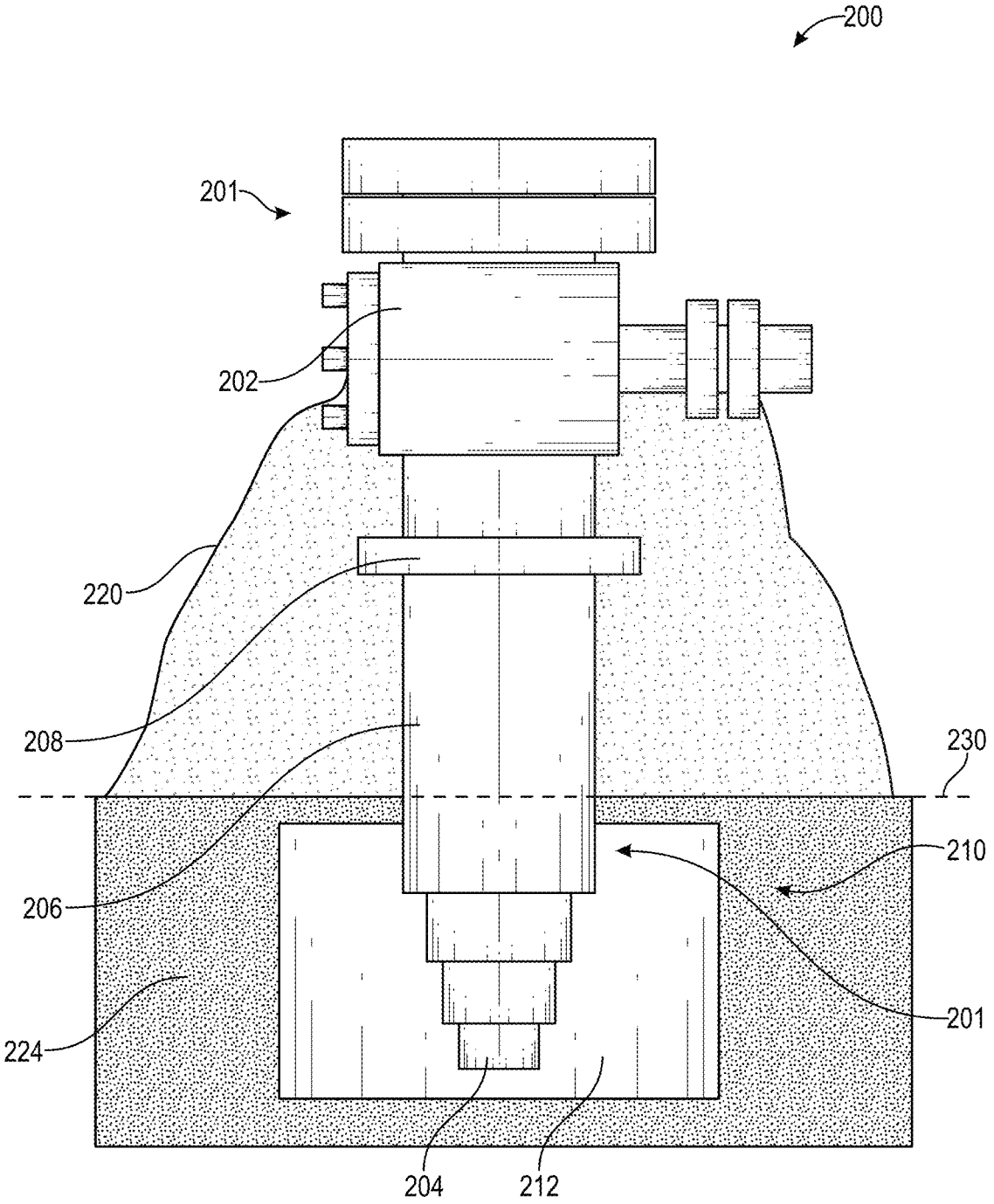
FIG. 2 illustrates an alternate nonlimiting example system comprising a wellhead and a hydrophobic sand pack.

FIG. 2 shows an alternate nonlimiting example alternate system wherein the wellhead is partially elevated and has a smaller well cellar than if it were not elevated. The system 200 may comprise a wellhead 201 that may comprise a landing base 202. The wellhead 201 may further comprise a wellhead pipe 204 extending from the landing base 202. The wellhead 201 may further comprise a surface casing 206 surrounding the wellhead pipe 204. The wellhead 201 may also have a donut plate 208 located on the surface casing 206. The wellhead 201 and constituent components may be located, at least partially, in a well cellar 210. The well cellar 210 may further comprise a cemented base 212, which may surround a portion of the surface casing 206.

The system 200 may further comprise a hydrophobic sand pack 220 that may, at least partially, surround portions of the wellhead including the landing base 202, the wellhead pipe 204, the surface casing 206, the cemented base 212, or any combination thereof. System 200 may comprise a hydrophobic sand pack 220 that is at and above ground level (ground level is indicated by reference character 230); however, as noted below, the hydrophobic sand pack may exist at ground level, below ground level, above ground level, or any combination thereof. The hydrophobic sand pack 220 may be at least partially located within the well cellar 210, may at least partially surround the well cellar 210, or any combination thereof. Additionally, in system 200, the hydrophobic sand pack 220 is shown at least partially resting on ground 224.

Containment Structure

The systems described herein may comprise a containment structure for the hydrophobic sand pack. The containment structure may serve to contain the hydrophobic sand pack at the wellhead. It should be noted that "contain" or "containment" as used herein refers to holding at least a portion (of any size) of a material (e.g., the hydrophobic sand pack) at a desired location and preventing movement relative to the location. Some movement may occur with the use of a containment structure and a portion of the material (e.g., the hydrophobic sand pack) may escape out of the containment structure. The containment structure may be located on top of the hydrophobic sand pack, below the hydrophobic sand pack, beside the hydrophobic sand pack, around the hydrophobic sand pack, within or between portions of the hydrophobic sand pack, or any combination thereof. The containment structure may be any suitable shape and size (including any suitable thickness) for containing the hydrophobic sand pack and may include features such as baffles, netting, pores, and the like, to prevent movement of the hydrophobic sand pack, to allow for draining of fluids that enter the hydrophobic sand pack, or any combination thereof.

The containment structure may exist above ground, below ground, at ground level, or any combination thereof. The containment structure may comprise any suitable material for containing the hydrophobic sand pack including, but not limited to, earth, sand, a rock, a polymer, a metal, wood, concrete, masonry, a fiber, a paper, the like, or any combination thereof.

Hydrophobic Sand Pack

The hydrophobic sand pack may exist above ground level, below ground level, at ground level, or any combination thereof.

The hydrophobic sand pack may have any suitable dimensions. Preferably the hydrophobic sand pack may extend from 0.1 ft to 500 ft, or 0.001 ft to 500 ft, or 1 ft to 100 ft, or 1 ft to 25 ft, or 1 ft to 10 ft, or 1 ft to 5 ft (0.03 m to 152 m, 0.0003 m to 152 m, or 0.3 m to 30 m, or 0.3 m to 7.7 m, or 0.3 m to 3 m, or 0.3 m to 1.5 m) radially from the centerline of the wellhead. The centerline of the wellhead, for the purposes of the present disclosure, may be defined as a largely vertical central line extending from top to bottom down the center of the wellhead and into the wellbore (for example, as shown by dashed line 140 in FIG. 1).

Preferably the hydrophobic sand pack may have a height from 0.1 ft to 500 ft, 0.001 ft to 500 ft, or 1 ft to 100 ft, or 1 ft to 25 ft, or 1 ft to 10 ft, or 1 ft to 5 ft (0.03 m to 152 m, 0.0003 m to 152 m, or 0.3 m to 30 m, or 0.3 m to 7.7 m, or 0.3 m to 3 m, or 0.3 m to 1.5 m). For the purposes of the present disclosure, height of the hydrophobic sand pack may be defined as from the top of the hydrophobic sand pack to the bottom of the sand pack as measured vertically.

Preferably the hydrophobic sand pack may have a depth below ground level from 0.1 ft to 500 ft, or 0.001 ft to 500 ft, or 1 ft to 100 ft, or 1 ft to 25 ft, or 1 ft to 10 ft, or 1 ft to 5 ft (0.03 m to 152 m, 0.0003 m to 152 m, or 0.3 m to 30 m, or 0.3 m to 7.7 m, or 0.3 m to 3 m, or 0.3 m to 1.5 m). For the purposes of the present disclosure, depth of the hydrophobic sand pack may be defined as from ground level to the bottom of the hydrophobic sand pack as measured vertically.

The hydrophobic sand pack may have any suitable shape. The hydrophobic sand pack may be partitioned into two or more portions, which may or may not be in direct contact with other portions.

It should be noted that the shape and dimensions of the hydrophobic sand pack may be restricted by a component of the wellhead, by surrounding equipment, by the features of the surrounding geological environment, the like, or any combination thereof. As a nonlimiting example, the hydrophobic sand pack may rest on and be supported from below by the ground surrounding the wellhead.

A hydrophobic sand pack according to the present disclosure may comprise hydrophobic sand. Hydrophobic sand, as used herein, may comprise sand and a hydrophobic compound. The hydrophobic sand may comprise from 50 wt % to 99.9999 wt % (or 50 wt % to 99.9 wt %, or 50 wt % to 95 wt %, or 50 wt % to 75 wt %, or 50 wt % to 90 wt %, or 90 wt % to 99.9999 wt %, or 90 wt % to 99.9 wt %) sand and from 0.0001 wt % to 50 wt % (or 0.001 wt % to 50 wt %, or 0.01 wt % to 50 wt %, or 1 wt % to 50 wt %, or 0.001 wt % to 25 wt %, or 0.1 wt % to 25 wt %, or 1 wt % to 25 wt %, or 0.0001 wt % to 10 wt %, or 0.001 wt % to 10 wt %, or 0.1 wt % to 10 wt %, or 1 wt % to 10 wt %) of a hydrophobic compound.

Sand may include minerals that include, but are not limited to, silicon dioxide, aluminosilicate, magnesium silicate, the like, or any combination thereof.

The sand may preferably comprise a plurality of particles, which may have an average (mean) particle size from 0.1 mm to 0.5 mm (or less than 6 mm, or less than 2 mm, or from to 0.002 mm to 2 mm, or from 0.02 mm to 2 mm, or from 0.2 mm to 2 mm, or from 0.6 mm to 2 mm, or from 0.125 mm to 1 mm) as measured by ISO 14688-1:2017.

The hydrophobic compound may comprise a silane compound such as an organosilane (e.g., trimethylsilanol (TMS)), an organofunctional alkoxysilane (e.g., an alkyl silane, an aryl silane, a fluoroalkyl silane), a chlorosilane, the like, or any combination thereof.

Figure 3:
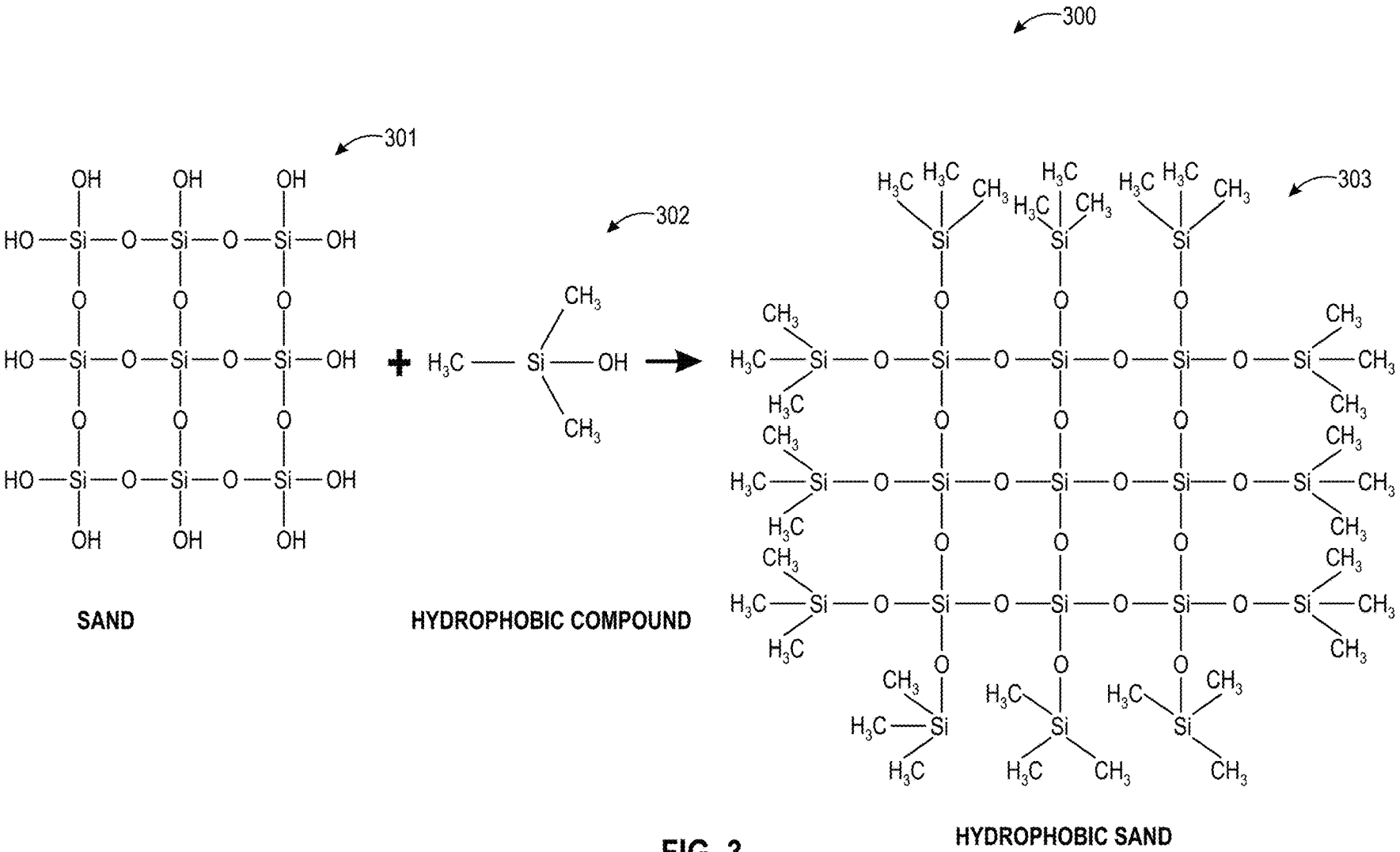
FIG. 3 illustrates a nonlimiting example reaction for forming hydrophobic sand.

Without being bound by theory, it is believed that the hydrophobic compound may form a covalent bond with sand particles in order to form a layer of hydrophobic compound surrounding each particle of sand. FIG. 3 shows a nonlimiting example of a reaction 300 in which a sand particle 301 is coated by a hydrophobic compound 302, resulting in a hydrophobic sand particle 303 that has been functionalized.

Without being bound by theory, the hydrophobic compound functionalizing the surface of the sand in turn is believed to prevent liquid water ingress into the hydrophobic sand pack due to molecular interactions between the liquid water and the hydrophobic compound that cause the hydrophobic compound to repel liquid water at and between particles of sand.

Preventing of liquid water ingress to portions of a wellhead may mitigate corrosion. Without being bound by theory, preventing liquid water ingress to a wellhead may mitigate corrosion by preventing contact with structures of the wellhead that typically would react with the liquid water in a corrosion reaction.

The hydrophobic sand may also resist swelling due to contact with liquid water. The hydrophobic sand of the hydrophobic sand pack may exhibit less than 1% swelling by volume upon being covered on an upward facing side with an equal volume of liquid water at 85° F. (29.4° C.) over a period of 24 hours.

The sand and the hydrophobic compound may be premixed before being placed at the wellhead using any suitable mixing method. The sand and the hydrophobic compound may be combined in-situ at the wellhead (e.g., the sand and the hydrophobic compound may both be placed in the desired general location and subsequently combined) using any suitable mixing method.

The hydrophobic sand pack may be, at least partially, compacted. "Compacted" as used herein refers to a material (e.g., sand or hydrophobic sand) that is compressed to cause the material to have a smaller volume.

The present disclosure may provide a method for mitigating wellhead corrosion utilizing the systems described herein. The method may include providing a wellhead comprising a landing base, providing a wellhead pipe wherein the wellhead pipe extends from the landing base, and providing a surface casing wherein the surface casing at least partially surrounds the wellhead pipe. The method may further include at least partially surrounding, with a hydrophobic sand pack comprising hydrophobic sand, the landing base, the wellhead pipe, the surface casing, or any combination thereof.

For the purpose of these simplified schematic illustrations and description, there may be additional valves, actuators, pumps, temperature sensors, electronic controllers, and the like that are customarily employed in wellhead or wellbore operations and that are well known to those of ordinary skill in the art but are not shown or described within the present disclosure.

Additionally, the compositions described herein may include additional additives and impurities that are well-known to those of ordinary skill in the art.

Example 1

An example system was prepared as shown in FIG. 4 (a photograph illustrating the experimental setup). A container was filled with, from bottom to top, a layer of dry silica sand 402, a layer of hydrophobic sand 404, a layer of wet silica sand 406, and layer of liquid water 408. After about 1 hour, the liquid water was not observed to penetrate the layer of hydrophobic sand 404, and the layer of dry silica sand 402 was not observed to have liquid water present.

Example 2

Another example was prepared as shown in FIG. 5 (a photograph illustrating the experimental setup). A container was filled with, from bottom to top, a layer of dry silica sand 502, a layer of hydrophobic sand 504, and layer of liquid water 508. After about 1 hour, the liquid water was not observed to penetrate the layer of hydrophobic sand 504, and the layer of dry sand 502 was not observed to have liquid water present.

ADDITIONAL EMBODIMENTS

Embodiment 1. A system comprising: a wellhead comprising: a landing base; a wellhead pipe, wherein the wellhead pipe extends from the landing base; and a surface casing, wherein the surface casing at least partially surrounds the wellhead pipe; a hydrophobic sand pack comprising a hydrophobic sand, the hydrophobic sand pack at least partially surrounding: the landing base, the wellhead pipe, the surface casing, or any combination thereof.

Embodiment 2. The system of Embodiment 1, wherein the wellhead further comprises a cemented base, and, optionally, wherein the hydrophobic sand pack at least partially surrounds the cemented base.

Embodiment 3. The system of Embodiment 1 or 2, wherein the hydrophobic sand is compacted.

Embodiment 4. The system of any one of Embodiments 1-3, wherein the hydrophobic sand comprises sand and a hydrophobic compound.

Embodiment 5. The system of Embodiment 4, wherein the hydrophobic sand comprises from 50 wt % to 99.9999 wt % sand.

Embodiment 6. The system of Embodiment 4, wherein the sand comprises a plurality of particles, and wherein the plurality of particles has an average particle size (ISO 14688-1:2017) from 0.6 mm to 2 mm.

Embodiment 7. The system of Embodiment 4, wherein the hydrophobic compound comprises a silane compound.

Embodiment 8. The system of Embodiment 7, wherein the silane compound comprises trimethylsilanol (TMS).

Embodiment 9. The system of any one of Embodiments 1-8, wherein an interior of the hydrophobic sand pack is, at least partially, in contact with: the landing base, the wellhead pipe, the surface casing, a cemented base, or any combination thereof.

Embodiment 10. The system of any one of Embodiments 1-9, wherein the hydrophobic sand pack is located at least partially within a well cellar, at least partially surrounds the well cellar, or any combination thereof.

Embodiment 11. The system of any one of Embodiments 1-10, wherein the hydrophobic sand of the hydrophobic sand pack exhibits less than 1% swelling by volume upon being covered on an upward facing side with an equal volume of liquid water at 85° F. (29.4° C.) over a period of 24 hours.

Embodiment 12. The system of any one of Embodiments 1-11, further comprising a containment structure, wherein the containment structure is designed to contain the hydrophobic sand pack at the wellhead.

Embodiment 13. The system of Embodiment 12, wherein the containment structure is above ground level, below ground level, or any combination thereof.

Embodiment 14. The system of Embodiment 12, wherein the containment structure comprises earth, sand, a rock, a polymer, a metal, wood, concrete, masonry, a fiber, or any combination thereof.

Embodiment 15. The system of any one of Embodiments 1-14, wherein the hydrophobic sand pack extends from 0.1 ft to 500 ft (0.03 m to 152 m) radially from a centerline of the wellhead.

Embodiment 16. The system of any one of Embodiments 1-15, wherein the hydrophobic sand pack has a height from 0.1 ft to 500 ft (0.03 m to 30 m).

Embodiment 17. The system of any one of Embodiments 1-16, wherein the hydrophobic sand pack has a depth below ground level from 0.1 ft to 500 ft (0.03 m to 30 m).

Embodiment 18. A system comprising: a wellhead comprising: a landing base; a wellhead pipe, wherein the wellhead pipe extends from the landing base; and a surface casing, wherein the surface casing at least partially surrounds the wellhead pipe; a hydrophobic sand pack comprising a hydrophobic sand, wherein the hydrophobic sand comprises trimethylsilanol (TMS), and wherein the hydrophobic sand pack at least partially surrounds and is at least partially in contact with: the landing base, the wellhead pipe, the surface casing, or any combination thereof; and a containment structure, wherein the containment structure is designed to contain the hydrophobic sand pack at the wellhead.

Embodiment 19. A method comprising: providing a wellhead comprising: a landing base; a wellhead pipe, wherein the wellhead pipe extends from the landing base; and a surface casing, wherein the surface casing at least partially surrounds the wellhead pipe; at least partially surrounding the landing base, the wellhead pipe, the surface casing, or any combination thereof with a hydrophobic sand pack comprising a hydrophobic sand.

Embodiment 20. The method of Embodiment 19, further comprising surrounding, at least partially, with the hydrophobic sand pack, a cemented base of the wellhead.

Embodiment 21. The method of Embodiment 19 or 20, further comprising compacting the hydrophobic sand pack.

Embodiment 22. The method of any one of Embodiments 19-21, wherein the hydrophobic sand comprises sand and a hydrophobic compound.

Embodiment 23. The method of Embodiment 22, wherein the hydrophobic sand comprises from 50 wt % to 99.9999 wt % sand.

Embodiment 24. The method of Embodiment 22, wherein the sand comprises a plurality of particles, and wherein the plurality of particles has an average particle size (ISO 14688-1:2017) from 0.6 mm to 2 mm.

Embodiment 25. The method of Embodiment 22, wherein the hydrophobic compound comprises a silane compound.

Embodiment 26. The method of Embodiment 25, wherein the silane compound comprises trimethylsilanol (TMS).

Embodiment 27. The method of any one of Embodiments 19-26, further comprising contacting an interior of the hydrophobic sand pack, at least partially, with: the landing base, the wellhead pipe, the surface casing, a cemented base, or any combination thereof.

Embodiment 28. The method of any one of Embodiments 19-27, wherein the hydrophobic sand pack is located at least partially within a well cellar, at least partially surrounds the well cellar, or any combination thereof.

Embodiment 29. The method of any one of Embodiments 19-28, wherein the hydrophobic sand of the hydrophobic sand pack exhibits less than 1% swelling by volume upon being covered on an upward facing side with an equal volume of liquid water at 85° F. (29.4° C.) over a period of 24 hours.

Embodiment 30. The method of any one of Embodiments 19-29, further comprising providing a containment structure, wherein the containment structure is designed to contain the hydrophobic sand pack at the wellhead.

Embodiment 31. The method of Embodiment 30, wherein the containment structure is above ground level, below ground level, or any combination thereof.

Embodiment 32. The method of Embodiment 30, wherein the containment structure comprises earth, sand, a rock, a polymer, a metal, wood, concrete, masonry, a fiber, or any combination thereof.

Embodiment 33. The method of any one of Embodiments 19-32, wherein the hydrophobic sand pack extends from 0.1 ft to 500 ft (0.03 m to 152 m) radially from a centerline of the wellhead.

Embodiment 34. The method of any one of Embodiments 19-33, wherein the hydrophobic sand pack has a height from 0.1 ft to 500 ft (0.03 m to 30 m).

Embodiment 35. The method of any one of Embodiments 19-34, wherein the hydrophobic sand pack has a depth below ground level from 0.1 ft to 500 ft (0.03 m to 30 m).

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation used herein are merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such.

While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

What is claimed is:

1. A system comprising:

a wellhead comprising:

a landing base;

a wellhead pipe, wherein the wellhead pipe extends from the landing base; and a surface casing, wherein the surface casing at least partially surrounds the wellhead pipe;

a hydrophobic sand pack comprising a hydrophobic sand exhibiting less than 1% swelling by volume upon being covered on an upward facing side with an equal volume of liquid water at 85° F. (29.4° C.) over a period of 24 hours, the hydrophobic sand pack at least partially surrounding: the landing base, the wellhead pipe, the surface casing, or any combination thereof, wherein the hydrophobic sand comprises sand and a hydrophobic compound, wherein the hydrophobic compound comprises a silane compound, and wherein the hydrophobic sand pack is present below ground level and above ground level.

2. The system of claim 1, wherein the wellhead further comprises a cemented base, and wherein the hydrophobic sand pack at least partially surrounds the cemented base.

3. The system of claim 1, wherein the hydrophobic sand comprises from 50 wt % to 99.9999 wt % sand.

4. The system of claim 1, wherein the sand comprises a plurality of particles, and where the plurality of particles has an average particle size (ISO 14688-1:2017) from 0.6 mm to 2 mm.

5. The system of claim 1, wherein the silane compound comprises trimethylsilanol (TMS).

6. The system of claim 1, wherein the hydrophobic sand pack is located at least partially within a well cellar, at least partially surrounds the well cellar, or any combination thereof.

7. The system of claim 1, further comprising a containment structure, wherein the containment structure is designed to contain the hydrophobic sand pack at the wellhead.

8. The system of claim 7, wherein the containment structure comprises earth, sand, a rock, a polymer, a metal, wood, concrete, masonry, a fiber, or any combination thereof.

9. A method comprising:

providing a wellhead comprising:

a landing base;

a wellhead pipe, wherein the wellhead pipe extends from the landing base; and a surface casing, wherein the surface casing at least partially surrounds the wellhead pipe;

at least partially surrounding the landing base, the wellhead pipe, the surface casing, or any combination thereof with a hydrophobic sand pack comprising a hydrophobic sand, wherein the hydrophobic sand comprises sand and a hydrophobic compound and wherein the hydrophobic sand exhibits less than 1% swelling by volume being covered on an upward facing side with an equal volume of liquid water at 85° F. (29.4° C.) over a period of 24 hours, wherein the hydrophobic compound comprises a silane compound, and wherein the hydrophobic sand pack is present below ground level and above ground level.

10. The method of claim 9, further comprising at least partially surrounding a cemented base of the wellhead with the hydrophobic sand pack.

11. The method of claim 9, further comprising compacting the hydrophobic sand pack.

12. The method of claim 9, wherein the hydrophobic sand comprises from 50 wt % to 99.9999 wt % sand.

13. The method of claim 9, wherein the sand comprises a plurality of particles, and wherein the plurality of particles has an average particle size (ISO 14688-1:2017) from 0.6 mm to 2 mm.

14. The method of claim 9, wherein the silane compound comprises trimethylsilanol (TMS).

15. The method of claim 9, further comprising contacting an interior of the hydrophobic sand pack, at least partially, with: the landing base, the wellhead pipe, the surface casing, a cemented base, or any combination thereof.

16. A system comprising:

a wellhead comprising:

a landing base;

a wellhead pipe, wherein the wellhead pipe extends from the landing base; and a surface casing, wherein the surface casing at least partially surrounds the wellhead pipe;

a hydrophobic sand pack comprising a hydrophobic sand, wherein the hydrophobic sand comprises trimethylsilanol (TMS) and exhibits less than 1% swelling by volume upon being covered on an upward facing side with an equal volume of liquid water at 85° F. (29.4° C.) over a period of 24 hours, wherein the hydrophobic sand pack at least partially surrounds and is at least partially in contact with: the landing base, the wellhead pipe, the surface casing, or any combination thereof, and wherein the hydrophobic sand pack is present below ground level and above ground level; and a containment structure, wherein the containment structure is designed to contain the hydrophobic sand pack at the wellhead.

* * * * *